US006337633B1

(12) United States Patent
Foseide

(10) Patent No.: US 6,337,633 B1
(45) Date of Patent: Jan. 8, 2002

(54) ALARM CABLE

(75) Inventor: Knut Foseide, Oslo (NO)

(73) Assignee: Safety Cable AS, Oslo (NO)

( * ) Notice: Subject to any disclaimer, the term of this patent is extended or adjusted under 35 U.S.C. 154(b) by 0 days.

(21) Appl. No.: 09/647,803

(22) PCT Filed: Apr. 6, 1999

(86) PCT No.: PCT/NO99/00113

§ 371 Date: Oct. 5, 2000

§ 102(e) Date: Oct. 5, 2000

(87) PCT Pub. No.: WO99/52088

PCT Pub. Date: Oct. 14, 1999

(30) Foreign Application Priority Data

Apr. 6, 1998 (NO) ..... 981569
Oct. 13, 1998 (NO) ..... 984777

(51) Int. Cl.[7] ..... G08B 21/00

(52) U.S. Cl. ..... 340/687; 340/568; 340/540; 340/686; 340/691; 340/693

(58) Field of Search ..... 340/687, 568, 340/540, 686, 691, 693

(56) References Cited

U.S. PATENT DOCUMENTS 3,598,930 A * 8/1971 Desnoes ..... 179/175.5
3,774,189 A * 11/1973 Brown ..... 340/253 B
5,418,521 A 5/1995 Read ..... 340/568
5,440,441 A * 8/1995 Ahuja ..... 361/62
5,714,942 A * 2/1998 Buchanan ..... 340/686

FOREIGN PATENT DOCUMENTS

EP 0 470 058 A2 2/1992
GB 2 158 277 A 11/1985

* cited by examiner

*Primary Examiner*—Daniel J. Wu
*Assistant Examiner*—Tai T. Nguyen
(74) *Attorney, Agent, or Firm*—Young & Thompson

(57) ABSTRACT

Alarm cable II, wherein a siren is triggered when there is a loss of mains voltage, characterized in that a switch function (SW) in the connector (3) also registers that the alarm is not disconnected from the appliance that is to be secured. In the connector (3) there is also a fastening device (14, 15) which is connected to a circuit (8) which registers whether the fastener is released, and then triggers the alarm. In the plug (2) to the mains supply there is a microswitch (SW) which makes it possible to distinguish between attempted theft and regular power failure. A varistor and a gas discharger connected in parallel relation across the mains phase protect against lightning or surge voltage. There may be input terminals for telephone lines which allow pager or mobile phone signalling.

9 Claims, 8 Drawing Sheets

ALARM CABLE

CROSS REFERENCE TO RELATED APPLICATION

This is the 35 USC 371 national stage of international application PCT/NO99/00113 filed on Apr. 6, 1999, which designated the United States of America.

FIELD OF THE INVENTION

The invention relates to an alarm cable capable of being installed between electrical appliances and one or more power or data signal sources, thereby securing the appliance against theft in addition to functioning as a power or data signal supply cable.

With an alarm cable according to the invention, it is ensured that an alarm signal is triggered when an attempt is made to disconnect the alarm cable from the power or data signal source or the equipment that is to be secured. This will complicate the execution of a theft.

BACKGROUND OF THE INVENTION

U.S. Pat. No. 5,418,521 teaches an alarm cable which, apart from the regular conductors for mains current (and earth), also comprises two conductors which form part of a current loop around the alarm cable plug to the mains socket outlet, wherein positioned within the plug is a switch for closing or opening the current loop upon disconnection from or connection to the mains socket outlet. The switch is embedded in the plug, but can nevertheless be actuated via an arm on connection to or disconnection from the mains supply.

U.S. Pat. No. 5,418,521 has no facility for discriminating between an alarm signal in the event of an actual attempted theft and an alarm signal in the event of an ordinary loss of supply voltage, inasmuch as it detects changes of state of the switching loop in the same loop as it detects supply voltage presence.

Furthermore, the alarm cable in the U.S. patent is not capable of triggering an alarm when the alarm cable is disconnected from the equipment that is to be secured if an unauthorised person first peels off the insulation around the cable, and connects an external loop in the switching loop between the alarm electronics box and the connector at the end of the cable.

Another weakness of the U.S. patent is that the "alarm box" is located at a point along the cable between the connectors at the two ends of the cable, which means that the acoustic alarm signalling unit is easily accessible to unauthorised persons who can deaden the alarm sound in a number of ways, e.g., by lowering the whole "alarm box" into a container full of water.

A further weakness with the U.S. patent is that the alarm circuit is not connected to any locking function for the cable to the equipment that is to be secured. This means that an unauthorised person can disconnect the alarm cable from the equipment that is to be secured, and leave the alarm behind whilst disappearing with the equipment that is to be secured.

SUMMARY OF THE INVENTION

Referring to FIGS. 1*a*, 1*b*, 2, 3, 4 and 5, it is therefore an object of the invention to provide an alarm cable which includes at least two connector devices selected from a number of different types of connector, wherein each connector device includes an electric switch, which switch forms an electric switching loop which is closed when the connector device is brought together with a female connector and is opened when the connector device is moved from a female connector, at least one alarm signalling device, and at least one electrically conducting wire of the multi-conductor type to form electrical connections between the connector devices of the alarm cable, wherein at least one connector device is connected to the conductors in a wire, whereof two conductors at the first end area of the wire are connected electrically to their respective sides of the switching loop to form a current loop, characterised in that at least one connector device also includes a loop detector having a plurality of inputs connected respectively to the respective switching loop of the connector and to two current loop conductors of the connecting wires at the other end area of the wires, which loop detector supplies a signal when there is a change in one or more of the electrical properties of the current loop or when there is a change of state in the aforementioned respective switching loop, a voltage detector, which voltage detector detects the presence of an electric voltage supplied from an external electric power source through one or more connector devices and which gives a signal upon loss of voltage, a control circuit connected to the loop detector and the voltage detector, which control circuit sends a control signal of limited duration in response to the presence of a signal from the voltage detector only, which control circuit sends a prolonged control signal in response to the presence of signals from the loop detector only or on the concurrent presence of signals from both the loop detector and the voltage detector, and an alarm signalling device which receives the aforementioned control signals and which gives at least one alarm signal in response to the presence of control signals.

Protection of equipment is achieved according to the invention in that an alarm cable is plugged into the power or data signal input terminal in the equipment that is to be secured, and to a power or data signal source, such as the mains supply. Voltage from the power or data signal source is detected by a voltage detector. Furthermore, there runs from a control circuit a current loop via switches in the alarm cable connectors, which is opened or closed upon disconnection from or connection to the equipment that is to be secured and also the power or data signal source. A similar current loop at the loop detector of resistor elements in the cable connectors detects any changes of state in the electrical properties of the loop, and gives an alarm on "unauthorised connection" of the loop along the cable between the connectors. In another current loop a fixing pin(screw) and (a washer at) the fastening piece are connected in series, so that via the control circuit a prolonged alarm signal is given when changes in the electrical properties of the loop occur upon unauthorised manoeuvring of the fixing pin.

DETAILED DESCRIPTION OF THE INVENTION

Figure 1A:
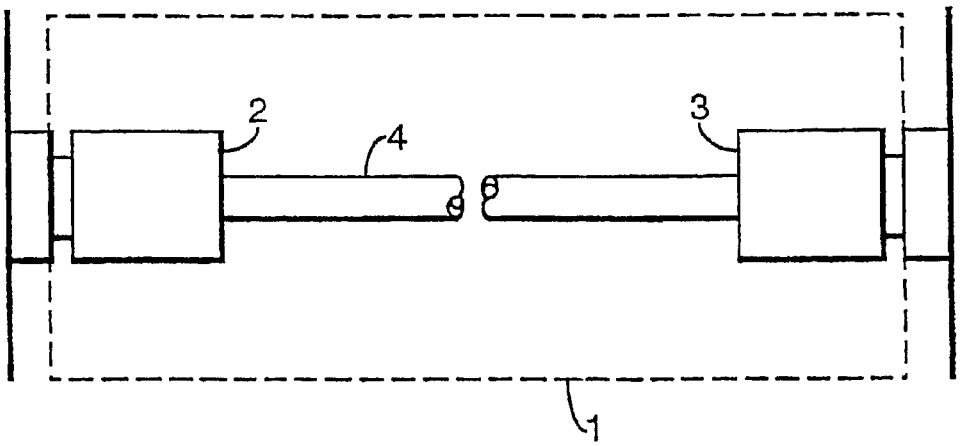
FIGS. 1*a*, 1*b*, 2, 3, 4 and 5 depict an alarm cable according to the invention for installation between the mains outlet socket and the power input terminal of the appliance that is to be secured.
Figure 1B:
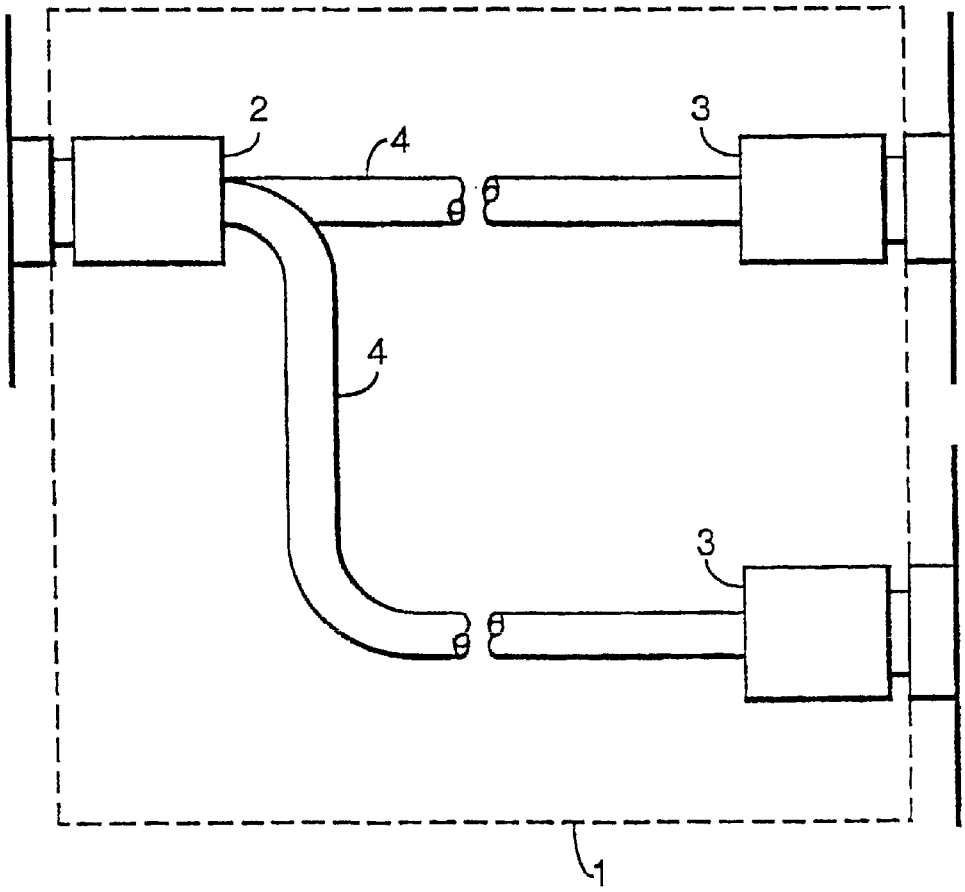
Figure 2:
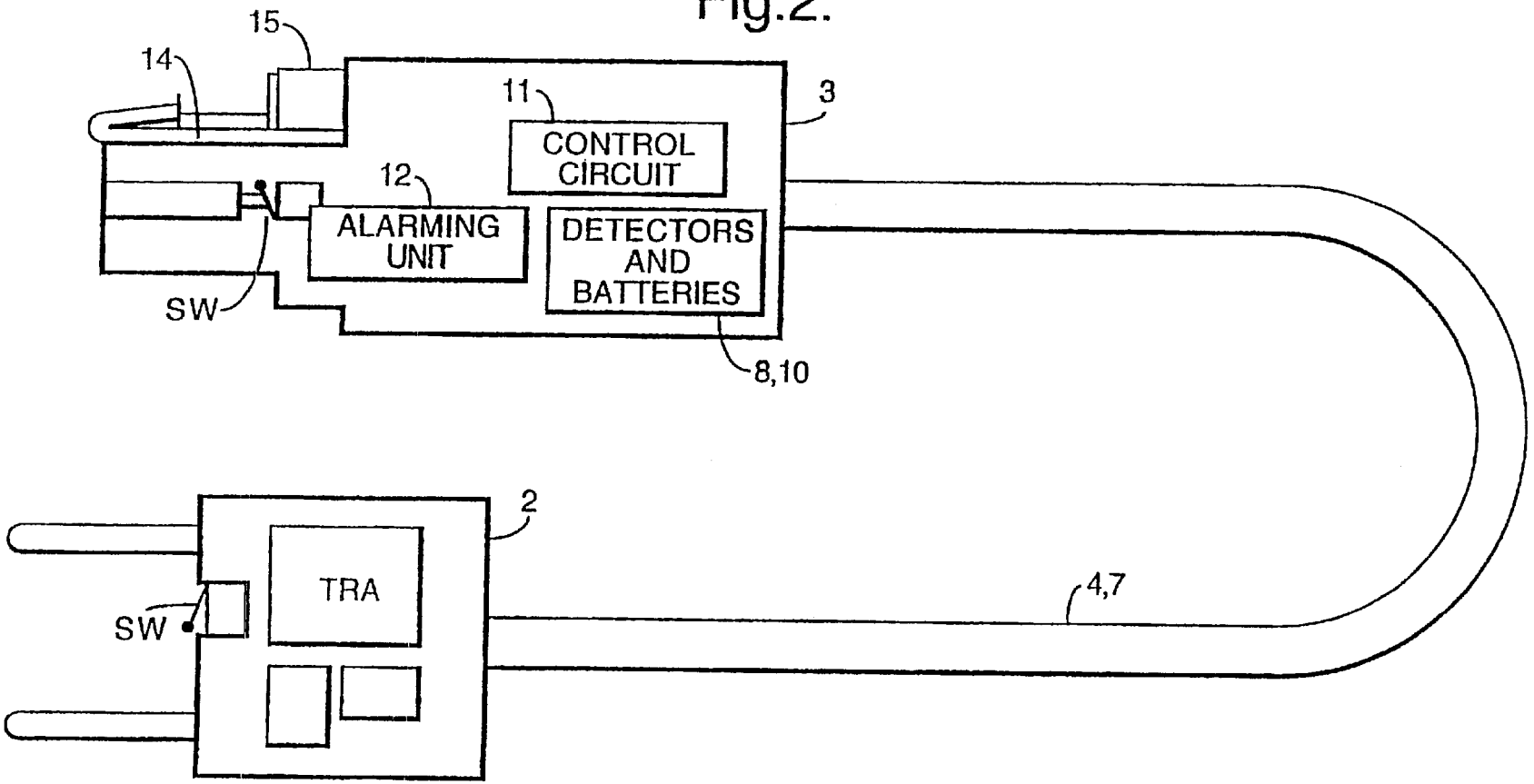
Figure 3:
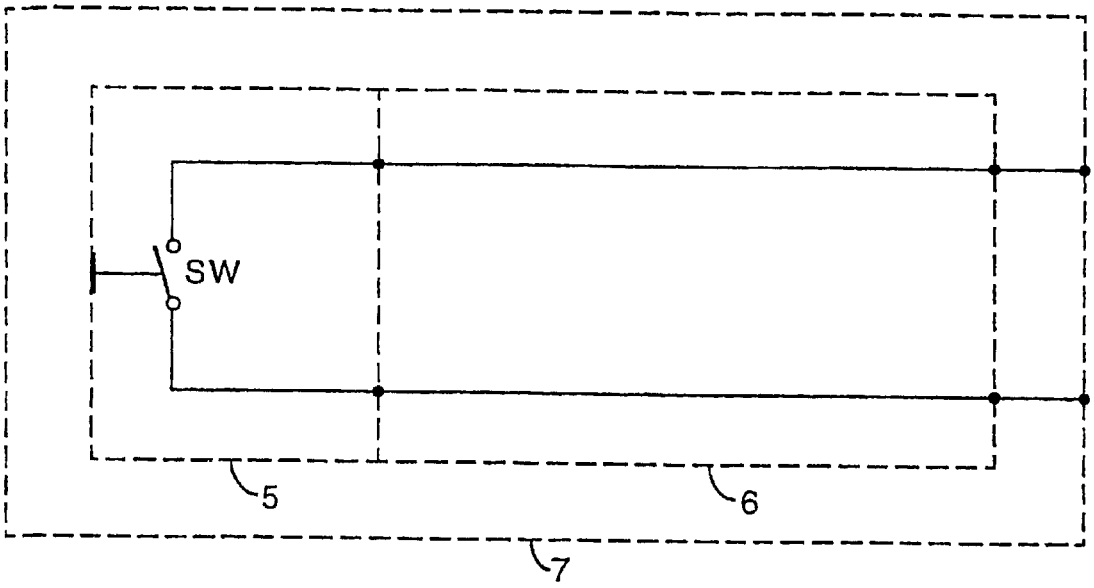
Figure 4:
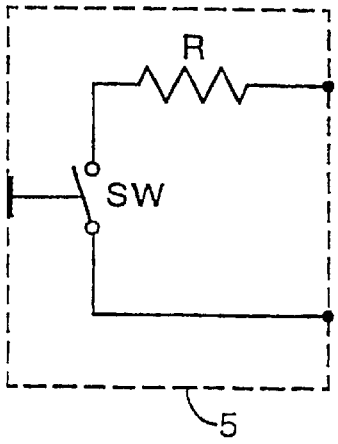
Figure 5:
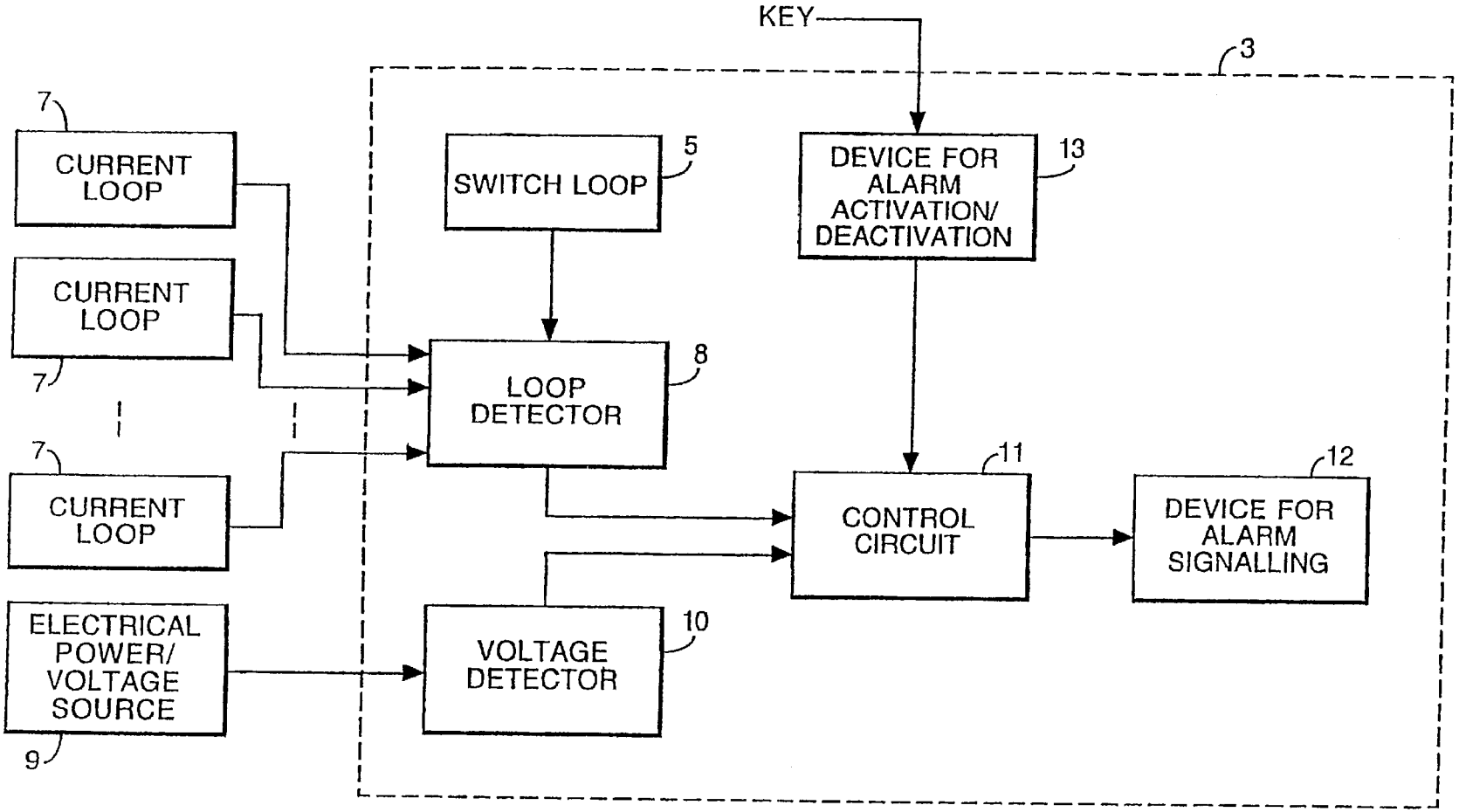

Referring to FIG. 2, seen in conjunction with FIGS. 1*a*, 1*b*, 3, 4 and 5, an example of a preferred embodiment of the alarm cable according to the invention is described below.

The same reference numerals indicate the same elements. The embodiment describes an alarm cable for installation between the mains outlet socket and the power input terminal of the appliance that is to be secured.

The alarm cable is supplied with current from the 230V mains supply 9 via transformer TRA and from a separate floating battery. The transformer TRA is located in the plug 2 of the cable together with associated rectifier and smoothing capacitor. The transformer inlet is protected against surges by means of a varistor. The battery and a voltage regulator are located in the appliance part 3 of the cable. Battery maintenance and conditioning are controlled by a microcontroller which functions as control circuit 11.

A separate voltage detector 10 detects whether a 230V mains supply is present by measuring whether the transformer provides sufficiently high voltage. When voltage is unduly low, a message is given to microcontroller 11.

A common switching loop 7 detects whether a microswitch SW in the connector part 2 or a microswitch SW in the appliance part 3 is tripped because the cable is unplugged. Detection is effected by measuring whether a series resistance R of normally 1 kΩ is present or whether it is changed substantially (e.g., by a short circuit to 0V or by breaks in the cable at 4, 6) by comparison with known values.

The alarm cable 1 makes use of a plurality of connections for current loops 7 and switching loops 5. Breaks in one or more of these will be detected.

Loop breaks are detected by separate components which together form the loop detector 8, and status of the loops is monitored by microcontroller 11.

Six switches constitute the keypad. These are read directly by the microcontroller 11 and function as an input point for key codes which control the activation or deactivation 13 of alarm functions.

The alarm relaying unit 12 includes a separate acoustic alarm member for warning of alarms on direct control of microcontroller 11.

The control circuit 11 in this embodiment consists of a microcontroller circuit from Atmel, AT90S1200.

Alarm cable II according to the invention is shown in FIG. 2, which is a view of the alarm cable II from above, wherein: 3 is the connector, with the fastening piece 4; 8, 10, 11 and 12 constitute the alarm electronics; 4 is the wire between the connector 3 and the plug 2; 2 is the plug to the mains supply; SW is a microswitch in the plug 2. On installation, the connector 3 is inserted into the input terminal of the appliance that is to be secured, and after current connection alarm cable II is activated using the keypad.

Figure 6A:
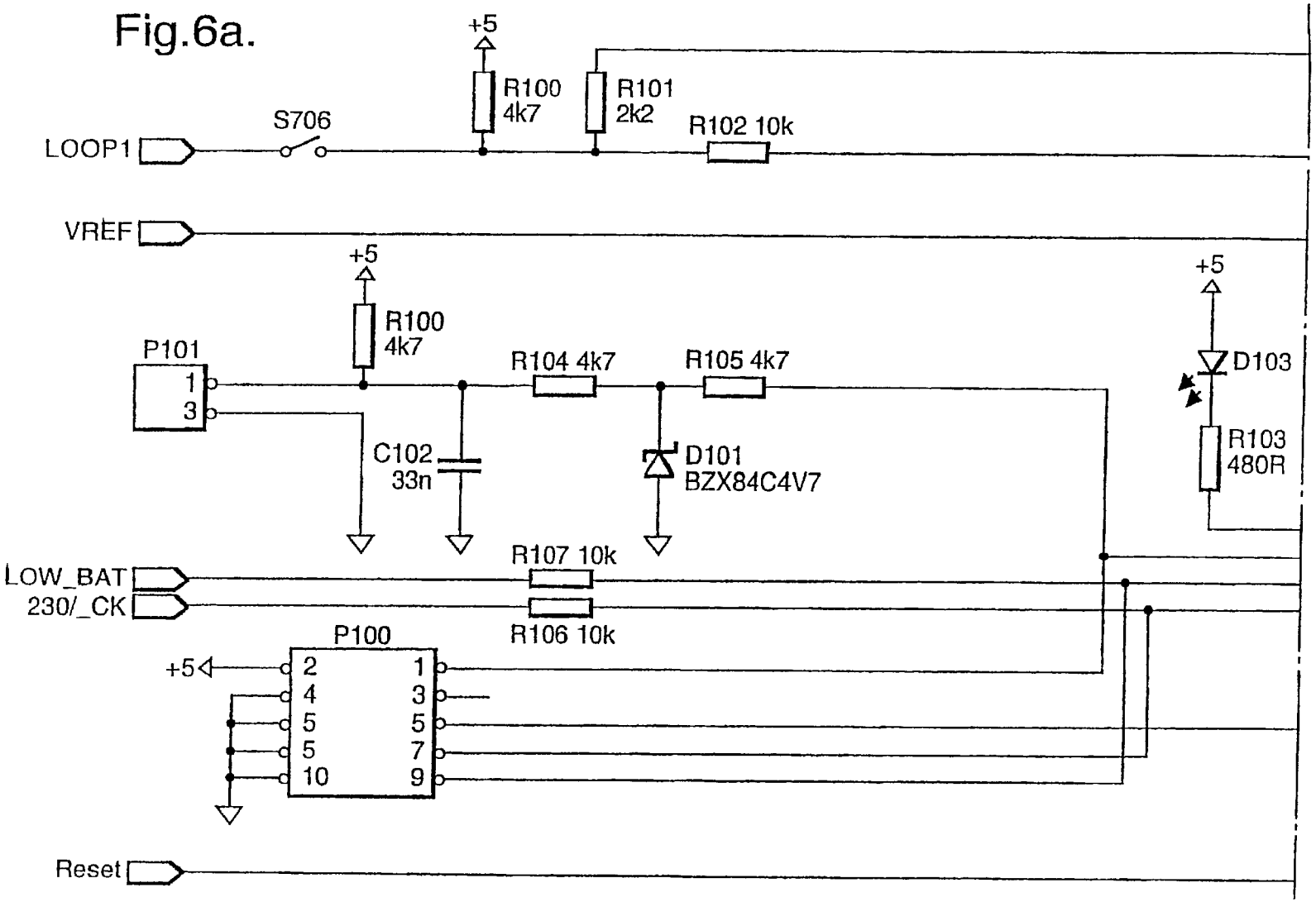
FIGS. 6*a*, 6*b* and 6*c* are schematic illustrations of electronic circuits for an embodiment according to the invention.
Figure 6A:
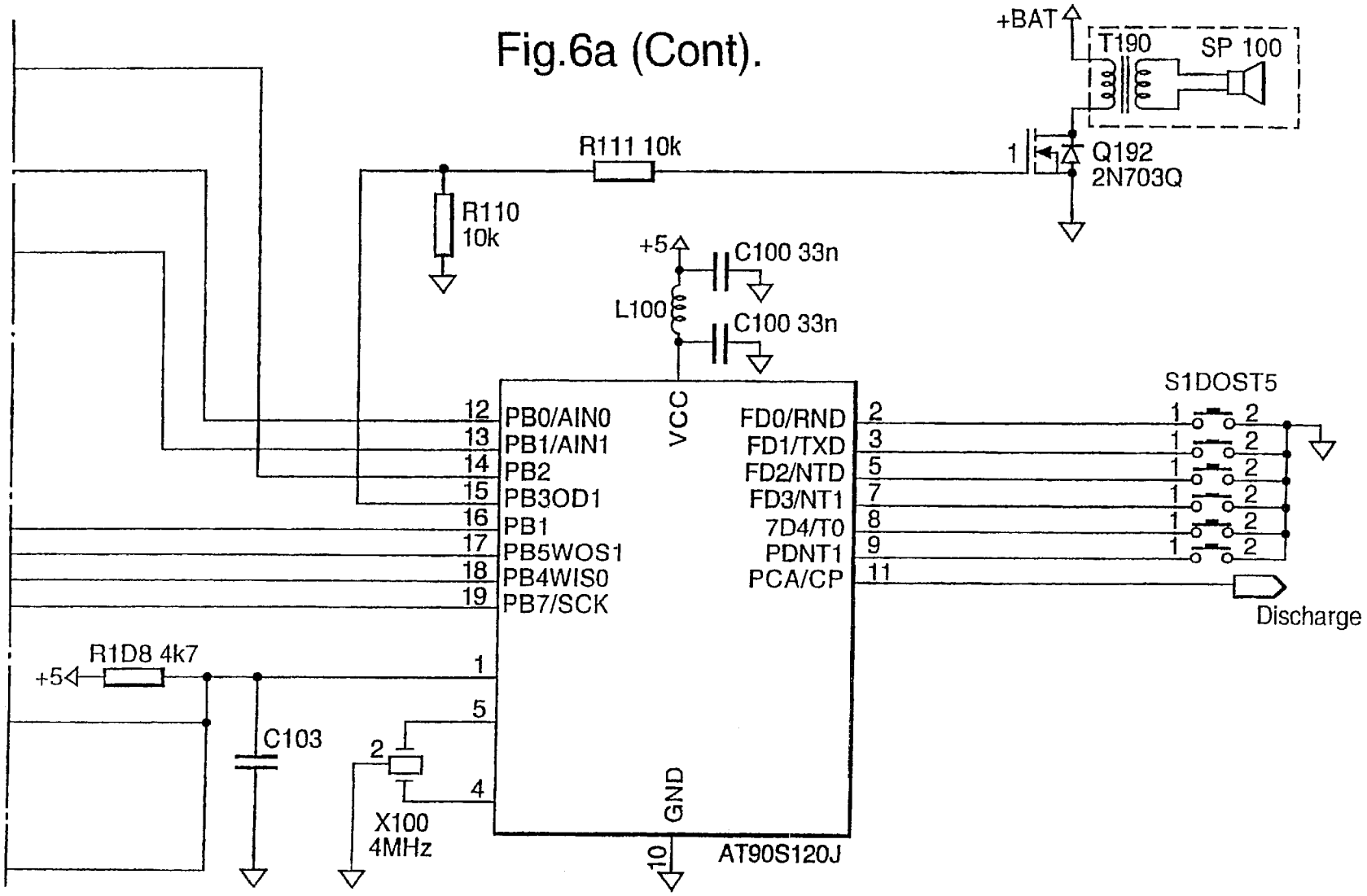
Figure 6B:
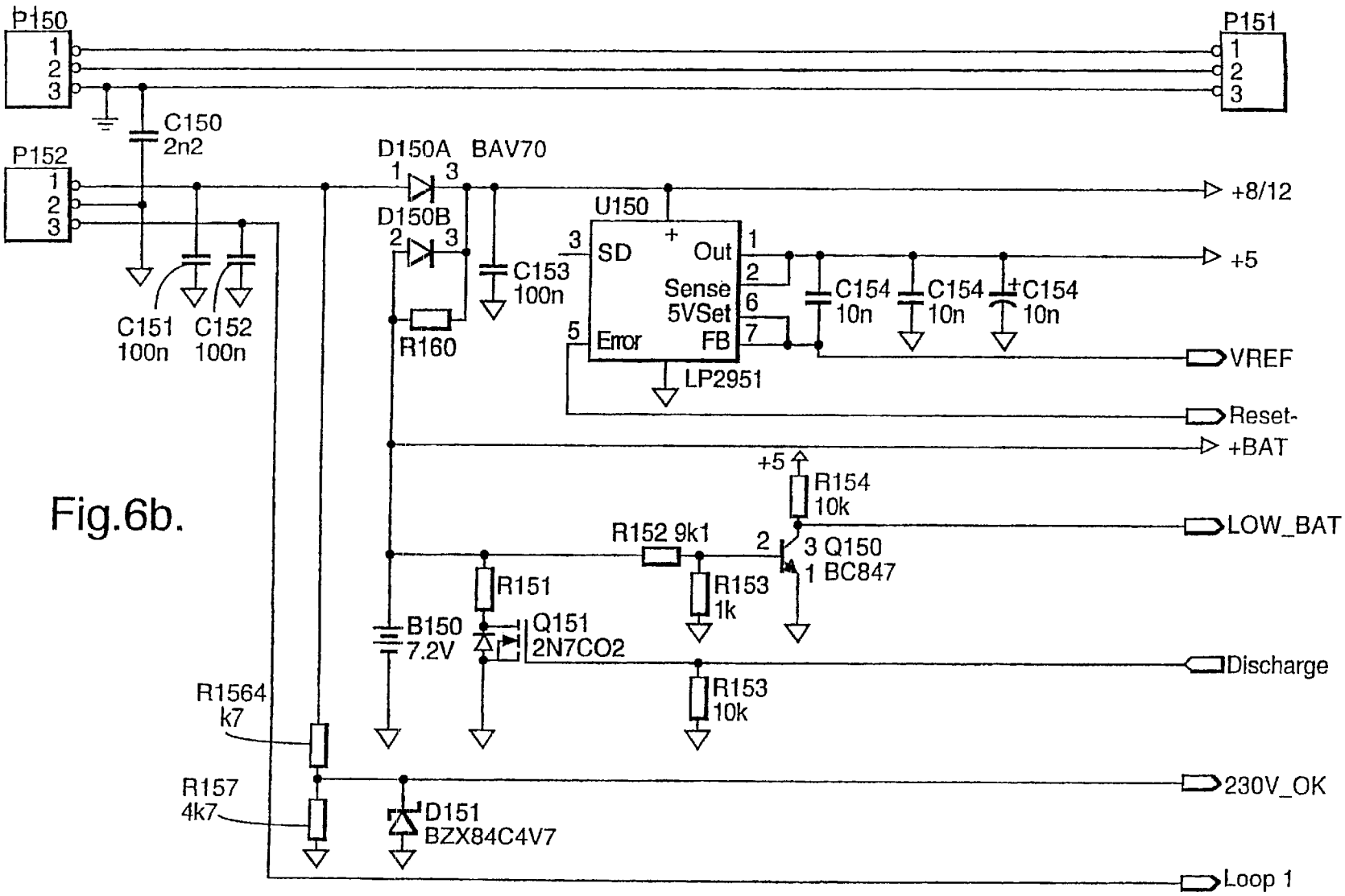
Figure 6C:
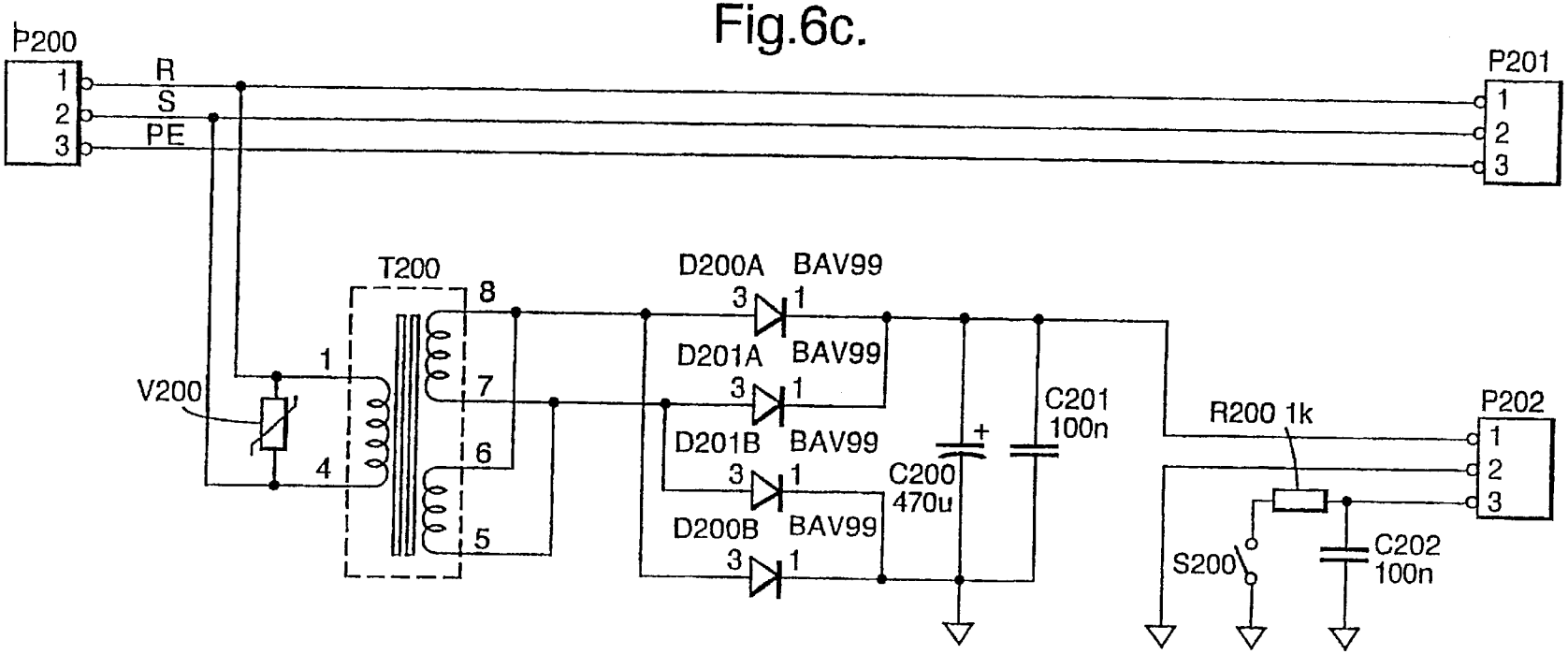

FIGS. 6*a*, 6*b* and 6*c* are schematic illustrations of electronic circuits for the embodiment described above which include a loop detector, a voltage detector, a control circuit, a signal alarm relaying device with acoustic transducer, power supply and battery with battery control circuit.

In FIG. 6*a* microcontroller U100, together with the resistors R100, R101 and R102, constitutes primarily control circuit 11 and loop detector 8, whilst SP100, T190 and R100 constitute the actual alarm signaler 12, and S100–S105 form the key input keypad for activating or deactivating 13. The switch S100 indicates switching loop 5 in the connector with control electronics.

FIG. 6*b* shows battery B150 together with the battery control circuit active components Q150 and Q151, and electronics U150 and D151 for voltage monitoring and detection 10.

FIG. 6*c* shows electronics power supply with 220V input, with stepping down by the transformer T200 and rectifying by D200A, D201A, D200B and D201B.

What is claimed is:

1. An alarm cable (1) including at least two electric connector devices (2, 3) selected from a number of different types of connector wherein each connector device includes an electric switch SW, which switch forms an electric switching loop (5) which is closed when the connector device is brought together with a female connector and is opened when the connector device is moved from a female connector, at least one alarm signalling device, and at least one electrically conducting wire (4) of the multi-conductor type to form electric connections between the alarm cable connector devices, wherein at least one connector device is connected to the conductors of a wire, whereof two conductors (6) at the first end area of the wire are connected electrically to each side of the respective switching loop of the connector device to form a current loop (7), characterised in that at least one connector device further comprises a loop detector (8) having a plurality of inputs connected respectively to the respective switching loop of the connector and to two current loop conductors of the connecting wires at the other end area of the wires, which loop detector gives a signal when a change in one or more of the electrical properties of the current loops occurs or when there is a change of state in the aforementioned respective switching loop;

a voltage detector (10), which voltage detector detects the presence of an electric voltage supplied from an external electric power source (9) through one or more connector devices and which gives a signal when there is a loss of voltage;

a control circuit (11) connected to the loop detector (8) and the voltage detector (10), which control circuit gives a control signal of limited duration in response to the presence of a signal from the voltage detector only, which control circuit gives a prolonged control signal in response to the presence of a signal from the loop detector only, or on the concurrent presence of signals from both the loop detector and the voltage detector; and an alarm signalling device (12) which receives the aforementioned control signals and gives at least one alarm signal in response to the presence of a control signal.

2. An alarm cable as disclosed in claim 1, characterised in that the alarm signalling device also includes means for transmission of alarm signals to remote alarm relaying equipment.

3. An alarm cable as disclosed in claim 1, characterised in that the alarm device also includes means for giving audible or visible warning signals.

4. An alarm cable as disclosed in claim 1, characterised in that in one or more switching loops (5) there is inserted an electric resistor element (R) electrically connected in series with respective switches.

5. An alarm cable as disclosed in claim 1, characterised in that it also includes a fastening device (14) provided with a release catch (15) having switching loop function, wherein the switching loop of the fastening device is opened by operating a fastening device release catch, the switching loop of the fastening device being connected to the loop detector (8).

6. An alarm cable as disclosed in claim 1, characterised in that it also includes an activation/deactivation device (13)

with key control, which device is connected to the control circuit (11) for selective activation and deactivation of alarm functions.

7. An alarm cable as disclosed in claim 1, characterised in that the current loops and switching loops are connected in electric series connection.

8. An alarm cable as disclosed in claim 1, characterised in that at least one connector device includes electric fusing elements to counteract overvoltage supplied from at last one external electric power source.

9. An alarm cable as disclosed in claim 8, characterised in that at least one external electric power source is selected from a group consisting of a regular electricity mains supply, a standing current generator and a data signal source.

* * * * *